US011767160B2

(12) United States Patent
Bolls et al.

(10) Patent No.: US 11,767,160 B2
(45) Date of Patent: Sep. 26, 2023

(54) FLAT-PACK SHIPPING CONTAINER

(71) Applicant: Boxwell LLC, Boulder, CO (US)

(72) Inventors: Rodney Wayne Bolls, Niwot, CO (US); Austin Trever Krueger, Mead, CO (US)

(73) Assignee: Boxwell LLC, Boulder, CO (US)

( * ) Notice: Subject to any disclaimer, the term of this patent is extended or adjusted under 35 U.S.C. 154(b) by 0 days.

(21) Appl. No.: 17/185,266

(22) Filed: Feb. 25, 2021

(65) Prior Publication Data

US 2022/0267086 A1 Aug. 25, 2022

(51) Int. Cl.
*B65D 88/52* (2006.01)
*B65D 90/00* (2006.01)

(52) U.S. Cl.
CPC ..... *B65D 88/522* (2013.01); *B65D 90/008* (2013.01); *B65D 2519/009* (2013.01)

(58) Field of Classification Search
CPC ..... B65D 88/522; B65D 2519/009; B65D 2519/00865; B65D 2519/0087; B65D 2519/00875; B65D 2519/0088; B65D 2519/00885; B65D 2519/0089; B65D 2519/00895; B65D 2519/00905; B65D 2519/0091; B65D 2519/00915; B65D 2519/0092; B65D 2519/00925; B65D 2519/0093; B65D 11/1833; B65D 90/008; B65D 90/0086; E06B 11/02; E04B 1/343; E04B 1/34357; E04B 1/34373; E04B 1/34384; E04B 1/3445; E04H 1/005; E04H 1/02; E04H 1/12; E04H 1/1205
See application file for complete search history.

(56) References Cited

U.S. PATENT DOCUMENTS 4,674,647 A * 6/1987 Gyenge ..... B65D 19/18 220/6
4,693,386 A * 9/1987 Hughes ..... B65D 11/1833 220/6
4,735,331 A * 4/1988 Keenan ..... B65D 11/1833 220/6
5,190,179 A 3/1993 Richter et al.
5,289,933 A * 3/1994 Streich ..... B65D 88/022 220/4.31

(Continued)

FOREIGN PATENT DOCUMENTS

CN 113086366 A * 7/2021
DE 102004012198 A1 * 9/2005 ..... B65D 19/18

(Continued)

*Primary Examiner* — Allan D Stevens
(74) *Attorney, Agent, or Firm* — The Ollila Law Group LLC

(57) ABSTRACT

The present invention relates to a folding container (100) that comprises a base (102) further comprising a floor (112). At least two side panels (104, 104') are mechanically attached to the base. A rear panel (106) comprises rear hinges (118) attached thereto that are pivotably connected to the base (102) and operable to pivot between a folded position that contacts the floor and a vertically deployed position. A hinge block (119) is attached to the base (102). A front panel (108) comprising a front door (109), and further comprising front hinges (122) is pivotably connected to the hinge block (119), and operable to pivot between a folded position that contacts the front panel (108) and a vertically deployed position.

7 Claims, 7 Drawing Sheets

(56) References Cited

U.S. PATENT DOCUMENTS

| | | | | |
|---|---|---|---|---|
| 5,601,202 | A * | 2/1997 | Meacham | B65D 11/1833 220/4.31 |
| 6,811,048 | B2 | 11/2004 | Lau | |
| 10,779,651 | B2 * | 9/2020 | Bai | E04C 2/20 |
| 2003/0136781 | A1 * | 7/2003 | Rumpel | B65D 21/0201 220/6 |
| 2004/0159659 | A1 * | 8/2004 | Rumpel | B65D 21/0224 220/7 |
| 2008/0169285 | A1 * | 7/2008 | Marazita | B65D 19/18 220/6 |
| 2009/0134057 | A1 * | 5/2009 | Hidalgo Vargas | B65D 11/1833 206/600 |
| 2009/0212049 | A1 * | 8/2009 | Anhel | B65D 19/18 220/4.28 |
| 2009/0272330 | A1 * | 11/2009 | Hampel | A01K 1/0209 119/515 |
| 2011/0168702 | A1 * | 7/2011 | Neufeld | B65D 19/12 220/6 |
| 2019/0270545 | A1 * | 9/2019 | Apps | B65D 21/083 |
| 2022/0169440 | A1 * | 6/2022 | Zacharia | B65D 90/0033 |

FOREIGN PATENT DOCUMENTS

| | | | | |
|---|---|---|---|---|
| EP | 1136389 | A2 * | 9/2001 | B65D 19/12 |
| EP | 1683727 | A1 * | 7/2006 | B65D 11/1833 |
| GB | 943661 | A * | 9/1961 | |
| WO | WO-03043900 | A1 * | 5/2003 | B65D 19/12 |
| WO | WO-2020178637 | A1 * | 9/2020 | B65D 19/12 |

* cited by examiner

FLAT-PACK SHIPPING CONTAINER

FIELD OF THE INVENTION

The present invention relates to shipping containers generally used to ship and store articles of freight. More particularly, the invention relates to a folding storage container which may be transported in a flat-pack configuration.

BACKGROUND OF THE INVENTION

Rigid shipping containers are frequently used to ship and to store freight at warehouses, wharves, and similar locations. Such containers typically consist of rectangularly-shaped box-like structures which are constructed from rectangularly-shaped metal panels that are fastened together to form the container. These containers are generally 20-foot or 40-foot steel boxes, and are often referred to as intermodal containers, International Organization for Standardization (ISO) containers, or Container Express (ConEx) boxes. Similar styles of container are often used for storage purposes.

Regardless of the particular specifications and dimensions, shipping containers are generally made from corrugated steel panels that are fastened together and welded together. Most containers comprise one or more doors which may be open on vertical axes to allow access to the interior space of the container—even when stacked.

It will be apparent that shipping containers of the type noted above are relatively bulky, and as such shipping empty containers is expensive. It would therefore be advantageous to have a shipping or storage container that could be shipped in a compact, collapsed, configuration that occupies significantly less volume than a fully assembled container.

A number of inventors have disclosed folding containers, including Lau in U.S. Pat. No. 6,811,048, and Johnson et. al in U.S. Pat. No. 9,080,326. However, folding these variants is either cumbersome or the unfolded design inhibits ease of use. In particular, containers less than 20 feet long do not accommodate folding end panels well. In some instances, the folding end panels interfere with each other, and prevent flat packing. In other instances, the end panel doors have large bottom lips that prevent the loading and unloading of cargo therein.

Accordingly, there is a need for an improved portable shipping and storage container that can be folded or disassembled into a configuration having a relatively small flat-packable volume. The present invention provides a fold-up storage container having structural and operational characteristics that enable the container to be shipped to a use site in a compact, relatively flat package, and be assembled on-site, yet has an interior space that is easily accessed when in the assembled state.

SUMMARY OF THE INVENTION

A folding container is provided according to an embodiment. The folding container comprises a base further comprising a floor, and at least two side panels are mechanically attached to the base. A rear panel comprising rear hinges attached thereto is pivotably connected to the base and operable to pivot between a folded position that contacts the floor and a vertically deployed position. A hinge block is attached to the base. A front panel comprising a front door and further comprising front hinges attached thereto, is pivotably connected to the hinge block and operable to pivot between a folded position that contacts the front panel and a vertically deployed position.

A method of assembling a folding container is provided according to an embodiment. The method comprises the steps of providing a base comprising a floor, attaching at least two side panels to the base, and pivotably attaching a rear panel to the base, wherein the rear panel is operable to pivot between a folded position that contacts the floor and a vertically deployed position. A hinge block is attached to the base. A front panel comprising a front door is pivotally attached to the hinge block, wherein the front panel is operable to pivot between a folded position that contacts the front panel and a vertically deployed position.

Aspects

According to an aspect, a folding container comprises a base further comprising a floor, and at least two side panels are mechanically attached to the base. A rear panel comprising rear hinges attached thereto is pivotably connected to the base and operable to pivot between a folded position that contacts the floor and a vertically deployed position. A hinge block is attached to the base. A front panel comprising a front door and further comprising front hinges attached thereto, is pivotably connected to the hinge block and operable to pivot between a folded position that contacts the front panel and a vertically deployed position.

Preferably, the rear panel comprises a rear door.

Preferably, a fulcrum of the rear hinges is approximately coplanar with the floor, and a fulcrum of the front hinges is approximately coplanar with an outward-facing surface of the rear panel, when the rear panel is in a fully folded position.

Preferably, a recess is defined by the base disposed proximate the front door, and an extension region is defined by the front door, wherein the extension region engages the recess when the front panel is the vertically deployed position, and wherein the recess comprises a size and dimension to accept the extension region.

Preferably, an interface of the extension region to the recess defines a door seal and a door travel limit.

Preferably, the front panel comprises support members attached to the front hinges, and the rear panel comprises support members attached to the rear hinges.

Preferably, the at least two side panels are foldable.

Preferably, a first horizontal riser disposed proximate the base, and a second horizontal riser disposed proximate the base. Hinges are attached to the first side panel and the first horizontal riser, wherein the first side panel is pivotably connected to the first horizontal riser. Hinges are attached to the second side panel and the second horizontal riser, wherein the second side panel is pivotably connected to the second horizontal riser. A fulcrum axis of the hinges is attached to the first side panel, and is approximately coplanar with an outward-facing surface of the front panel, when the front panel is in a fully folded position. A fulcrum axis of the hinges attached to the second side panel is approximately coplanar with an outward-facing surface of the first side panel, when the first side panel is in a fully folded position.

According to an aspect, a method of assembling a folding container comprises the steps of providing a base comprising a floor, attaching at least two side panels to the base, and pivotably attaching a rear panel to the base, wherein the rear panel is operable to pivot between a folded position that contacts the floor and a vertically deployed position. A hinge block is attached to the base. A front panel comprising a front door is pivotally attached to the hinge block, wherein the front panel is operable to pivot between a folded position that contacts the front panel and a vertically deployed position.

Preferably, the rear panel comprises a rear door.

Preferably, a fulcrum of the rear hinges is approximately coplanar with the floor, and a fulcrum of the front hinges is approximately coplanar with an outward-facing surface of the rear panel, when the rear panel is in a fully folded position.

Preferably, an extension region defined by the front door is provided, and a recess in the base that is disposed proximate the front door is defined, wherein the recess comprises a size and dimension to accept the extension region defined by the front door. The recess engages the extension region defined by the front door when the front panel is in the vertically deployed position.

Preferably, an interface of the extension region and the recess defines a door seal and a door travel limit.

Preferably, support members of the front panel are attached to the front hinge and a front door is attached to the support member.

Preferably, the at least two side panels are foldable.

Preferably, a first horizontal riser is attached to the base, and a second horizontal riser is attached to the base. At least one hinge is attached to the first side panel and the first horizontal riser, such that the first side panel is pivotably connected to the first horizontal riser. At least one hinge is attached to the second side panel and the second horizontal riser, such that the second side panel is pivotably connected to the second horizontal riser. A fulcrum axis of the at least one hinge attached to the first side panel is oriented approximately coplanar with an outward-facing surface of the front panel, when the front panel is in a fully folded position. A fulcrum axis of the at least one hinge attached to the second side panel is oriented approximately coplanar with an outward-facing surface of the first side panel, when the first side panel is in a fully folded position.

BRIEF DESCRIPTION OF THE DRAWINGS

The same reference number represents the same element on all drawings. The drawings are not necessarily to scale.

DETAILED DESCRIPTION

Figure 1A:
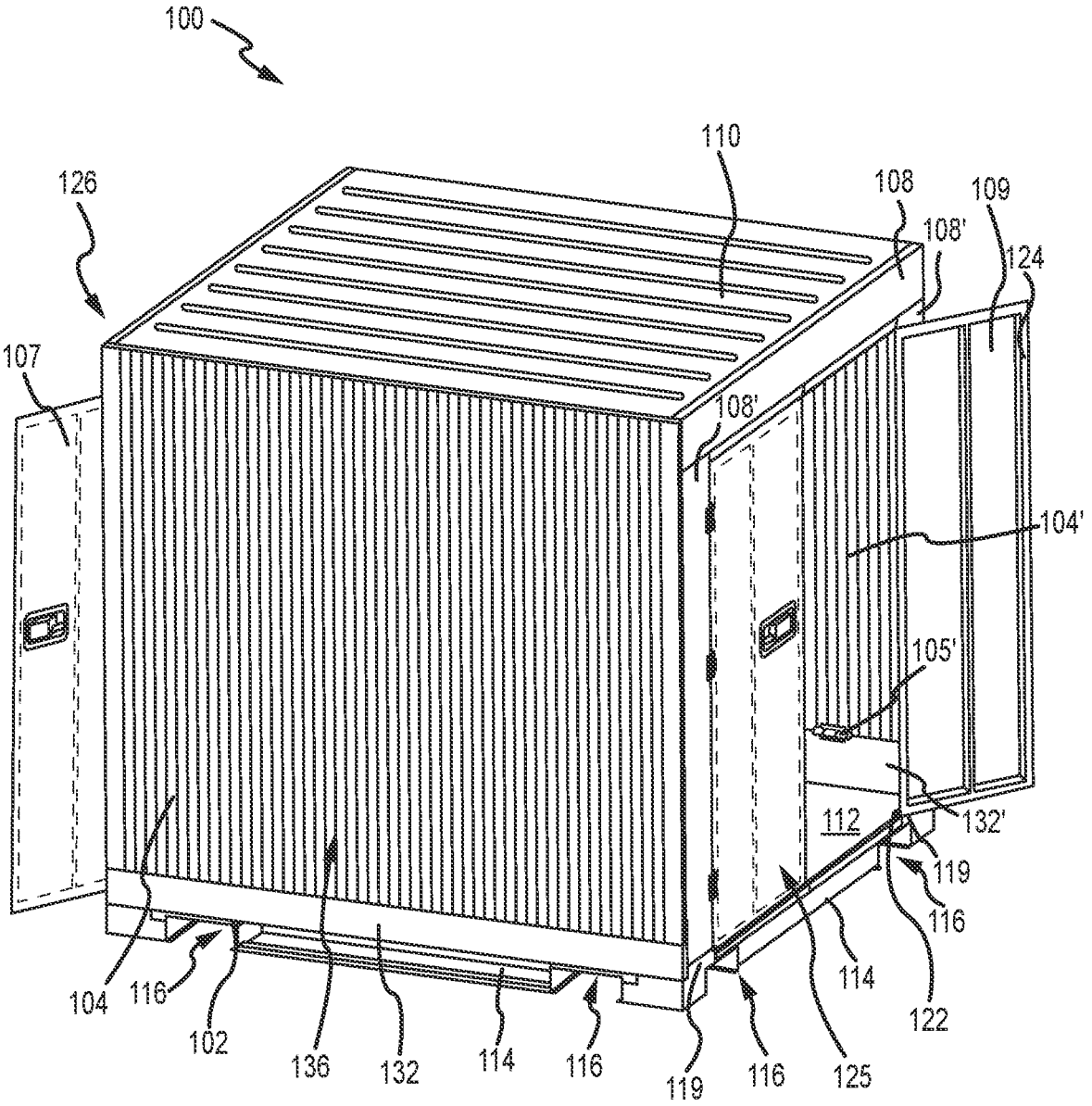
FIG. 1A illustrates a folding container according to an embodiment.
Figure 1B:
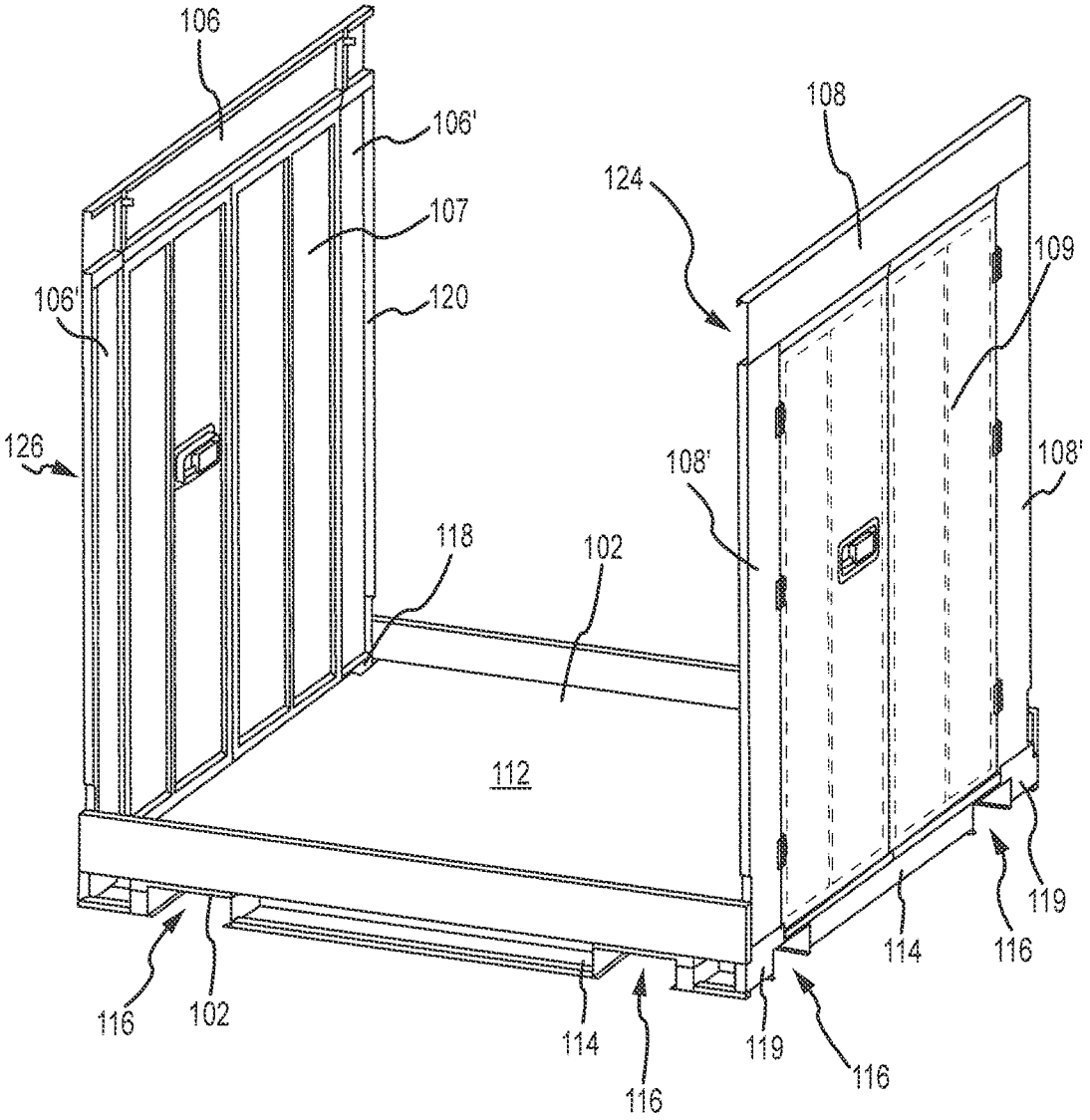
FIG. 1B illustrates a folding container according to an embodiment with the side panels and roof removed for clarity.

Referring first to FIGS. 1A-5, a folding container 100 according to the present embodiments comprises a plurality of generally flat, rectangularly-shaped panels which are foldably fastened together so to form a cuboid-shaped enclosure having an internal volume configured for storage and/or transport when the folding container 100 is in an unfolded state.

The folding container 100 comprises a base 102, side panels 104, 104', a rear panel 106, front panel 108, and roof panel 110. The side panels 104 may comprise one or more doors. The rear panel 106 may comprise a one or more rear doors 107, and the front panel 108 may comprise one or more front doors 109. Doors may be vertically hinged, horizontally hinges, rolling doors, removable panels, other door types known in the art, and combinations thereof. In the embodiments illustrated, the rear and front panels 106, 108 each comprise rear and front support members 106', 108' that support their respective doors 107, 109.

In general, all sides, doors, and/or insert panels of the folding container 100 may be fabricated from rectangularly-shaped corrugated sheet at least partially bounded by corners/members. Corrugated sheet may be substituted with door assemblies. Alternatively, corrugated sheet may comprise door or window assemblies. Combinations of folding container 100 panels may include any combination of sheet panels, doors, and/or panels comprising doors. Although corrugated sheet is common, non-corrugated panel material is contemplated. Metals, such as steel, are contemplated for door, panel, corner, braces, and any other structural members. However, other materials, such as wood, plastics, polymers, and composites may be used alone or in conjunction with metals.

The base 102 is preferably constructed from hollow tubing, angle stock, U-stock, sheet stock, and/or combinations thereof. The general plan view of the base is that of a substantially square or rectangular structure, and is generally rectilinear in nature. However, other polygonal or even rounded/arced portions may be present. Support members (not shown) of the base may traverse under the floor 112 to provide structural support thereto. Edge rails 114 provide perimeter support for the base 102, and provide anchor points for the support members. Lift points 116 provide space for forklift fork access.

The front and rear panels 108, 106 are hingedly or pivotably fastened to the base 102. The rear panel 106 comprises rear hinges 118 (visible in FIG. 1B) that are disposed at or below the level of the floor 112. The rear hinges 118 are attached to the base 102 and rear support members 106'. The rear panel 106 thus may hingedly fold such that the inward-facing surface 120 thereof may be made to contact the floor 112 when the rear panel 106 is in a "folded" or horizontal position. The front panel 108, however, comprises front hinges 122 (See FIG. 6) that are disposed on a plane higher than the level of the top plane of the floor 112. The distance the front hinge 122 is positioned from the floor 112 is based on the thickness of the rear panel. The distance the front hinge 122 is positioned from the floor 112 is so that the front panel 108 may hingedly fold such that the inward-facing surface 124 of the front panel 108 may be made to contact the outward-facing surface 126 of the rear panel 106 when both front and rear panels 108, 106 are in the folded position. The front hinges 122 are thus attached to the front support members 108' and corresponding hinge block 119. At least two hinges are associated with each front and rear panels 108, 106, each pair having colinear hinge axes.

In prior art containers, a riser rib is provided to enable a first panel to overlie a second panel. This unfortunately yields a container that having a riser rib that spans an entire edge of a container. In cases where doors are provided on a panel having a riser rib, the riser rib blocks access through the doors, and necessitates the lifting of cargo over the riser rib, thus hindering rolling carts, dollies, or lifts from accessing the interior space of the container.

FIGS. 2-6 illustrate the details of the folding mechanisms, and of the from front panel 108 in particular. A front panel 108 comprising a front door 109 is shown. In the embodiments illustrated, it is the rear panel 106 that folds first, and front panel 108 that folds from a "deployed" or vertical position down to a folded position second, and ultimately rests upon the rear panel 106 when in the folded position. In order for the front panel 108 to not bind on the rear panel 106 and to instead lay flat, the front hinges 122 are attached to hinge blocks 119 which place the fulcrum axis of the front hinges 122 in a position approximately coplanar with the outward-facing surface 126 of the rear panel 106 when the rear panel 106 is in the folded position.

Figure 6:
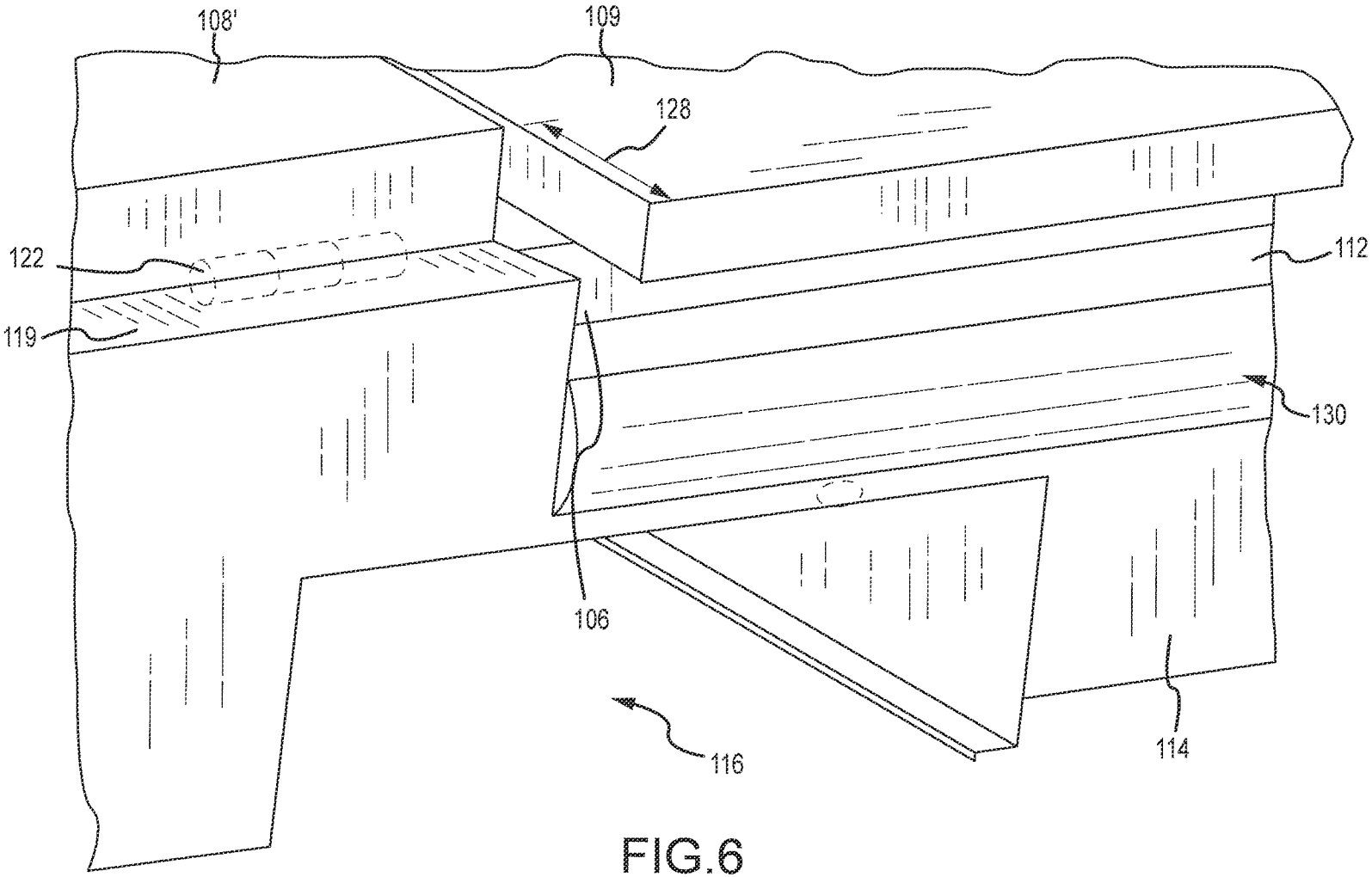
FIG. 6 illustrates a detail view of a portion of the folding container according to an embodiment.

A bottom region of the front door 109 extends past where a typical door would otherwise extend, so to facilitate proper sealing when the front door 109 is closed. FIG. 6 illustrates the extension region 128 of the front door 109 that passes past the topmost plane of the floor 112 when the front panel 108 is deployed. When the front panel is deployed, the extension region 128 of the front door 109 mates with a recess 130 defined by the base 102. The recess 130 serves as a limit stop for the front door 109 and also provides a bottom seal region for the doors that helps to prevent intrusion of the elements and debris. Furthermore, by providing an inward door travel limit, security is improved, as the door is resistant to being forcibly inwardly opened.

Figure 2:
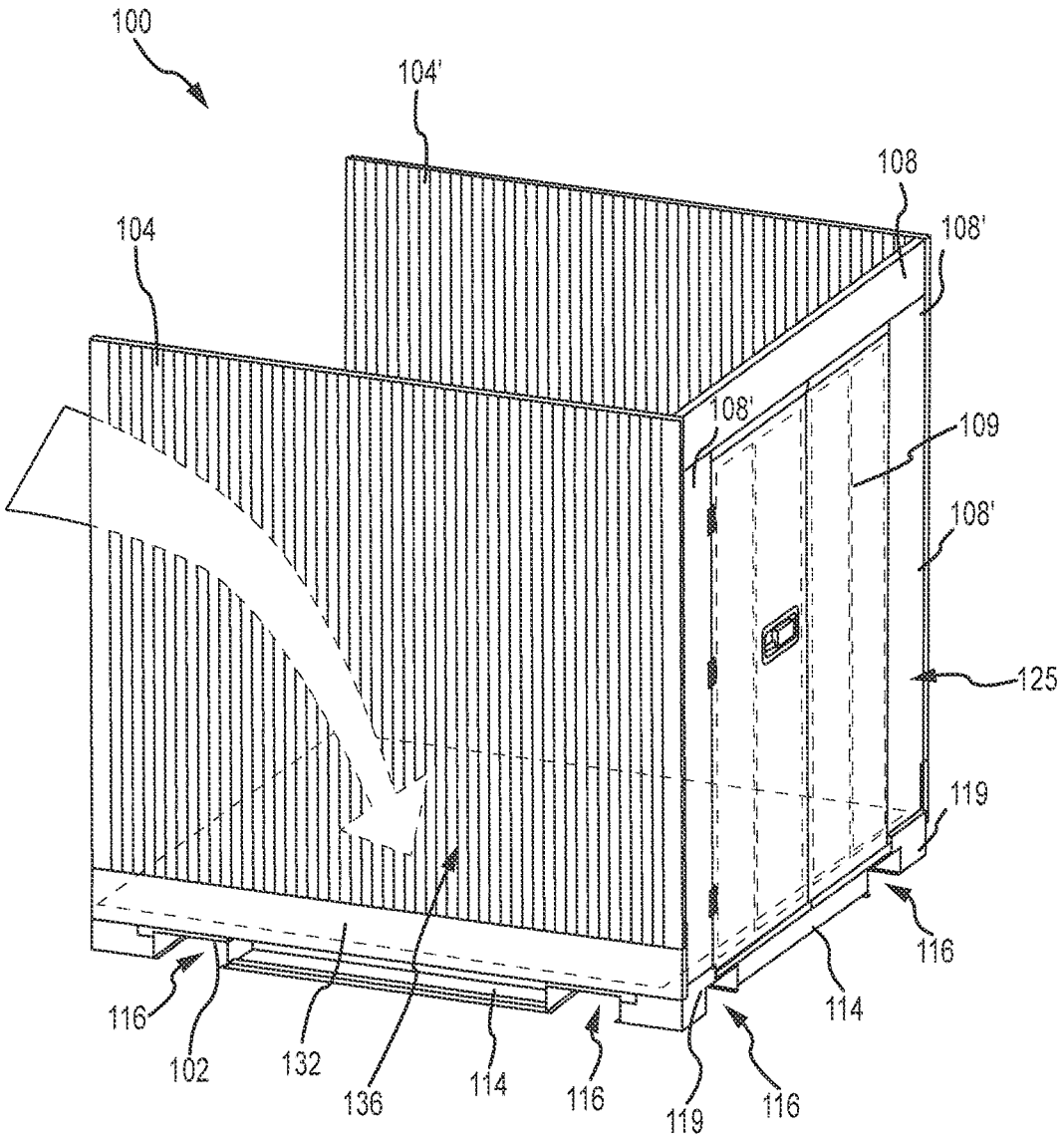
FIG. 2 illustrates the folding container with a rear panel in a folded position.
Figure 3:
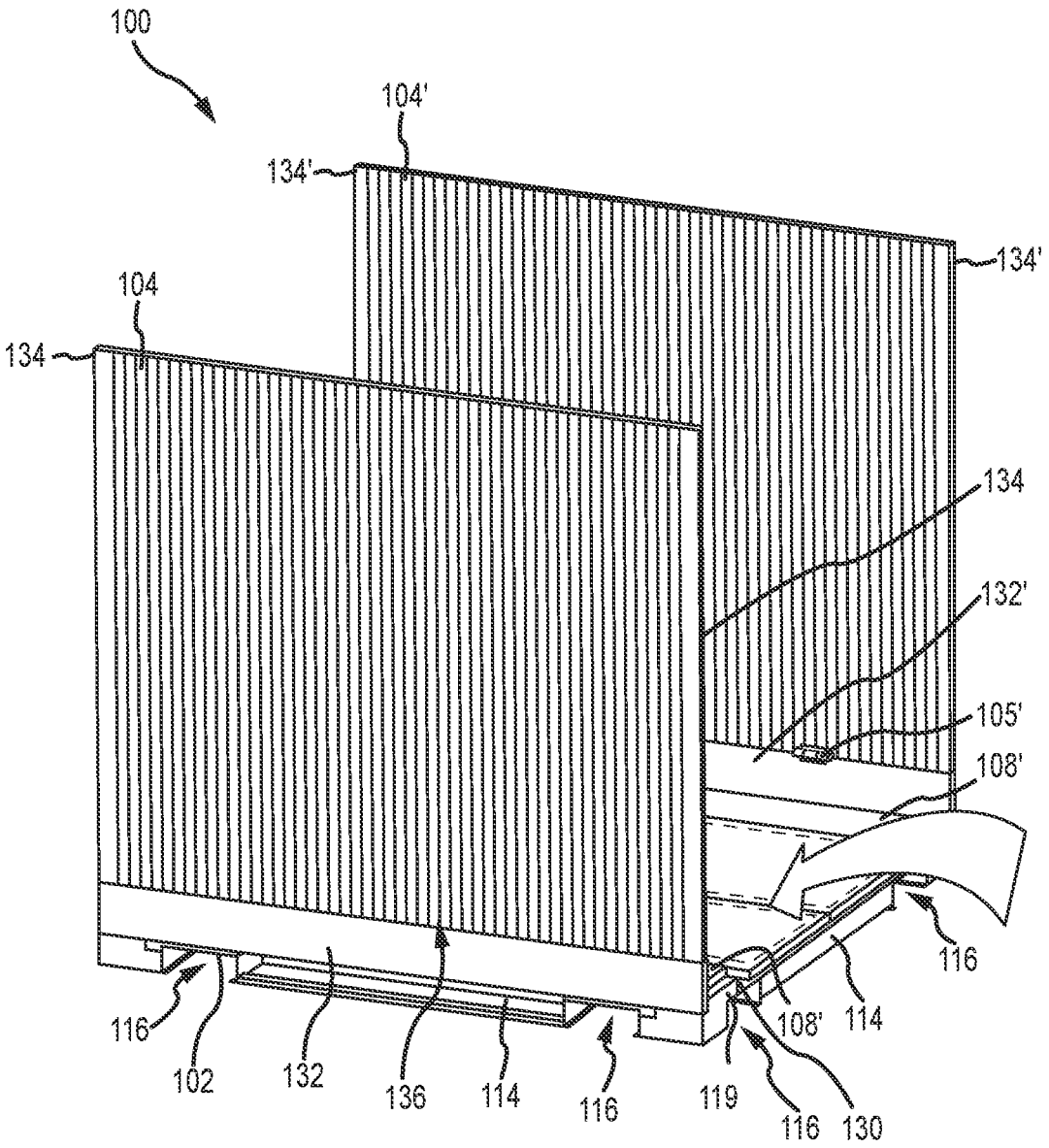
FIG. 3 illustrates the folding container with a rear panel and front panel both in a folded position.
Figure 4:
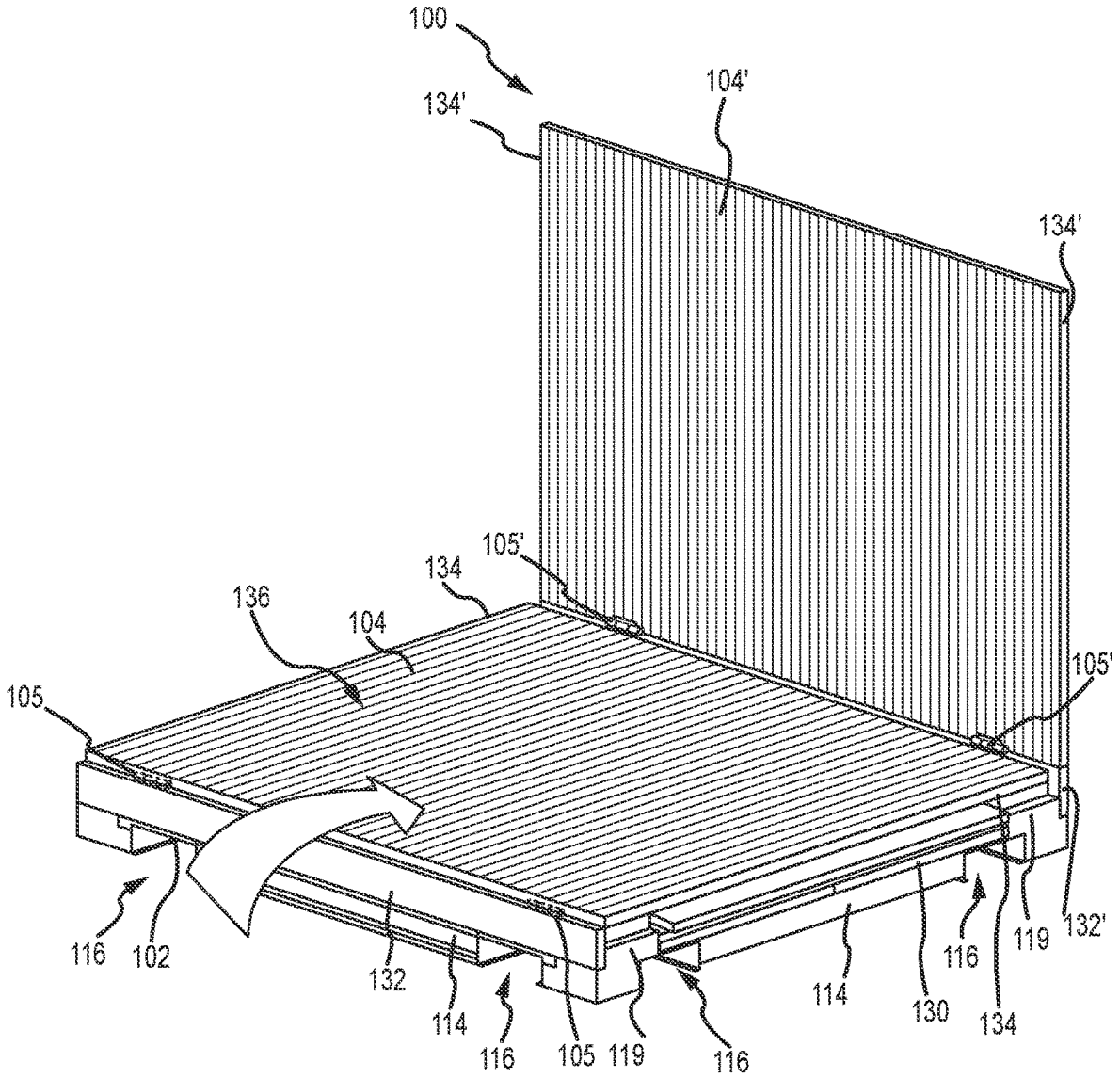
FIG. 4 illustrates the folding container with a rear panel and front panel both in a folded position in addition to a side panel a folded position.
Figure 5:
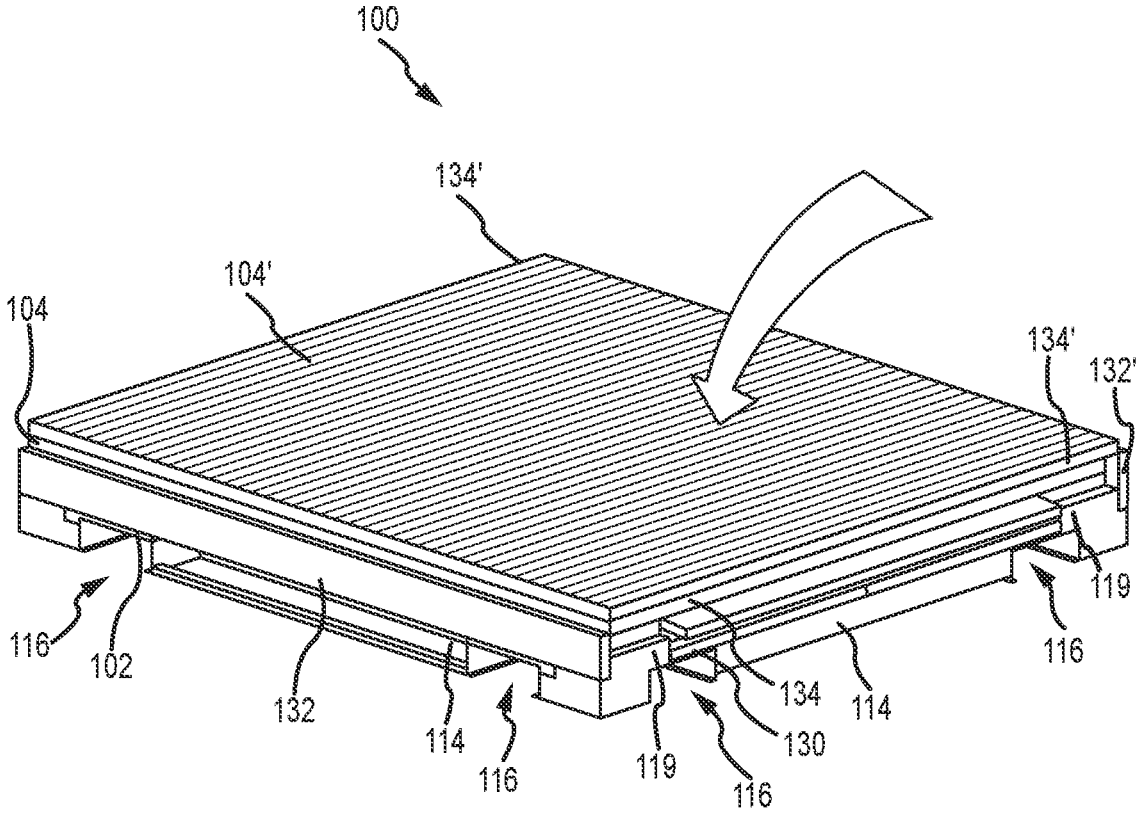
FIG. 5 illustrates the folding container with a rear panel and front panel both in a folded position in addition to both side panels in folded positions.

A method of folding the folding container 100 is provided. From a fully assembled state, illustrated in FIG. 1, hardware that attaches the roof panel 110 and hardware that attaches the rear panel 106 to the side panels 104, 104' is removed. The rear panel 106 is hingedly folded from a vertically deployed position until it is resting horizontally on the floor 112 in a folded position, as is illustrated in FIG. 2. FIG. 3 illustrates folding the front panel 108 from a vertically deployed position until it is resting horizontally on the rear panel 106 in a folded position. It will be understood that any hardware that attaches the front panel 108 to the side panels 104, 104' is removed or unengaged before this operation. FIG. 4 illustrates folding a side panel 104 from a vertically deployed position until it is resting horizontally on the front panel 108 in a folded position. Likewise, FIG. 5 illustrates folding the opposing side panel 104' from a vertically deployed position until it is resting horizontally on the side panel 104 that was folded immediately prior. It will be clear to those skilled in the art that to assemble the folding container 100 from a folded position that the steps outlined above will be carried out in the reverse order.

At least one hinge 105, 105' is respectively attached to each of the side panels 104, 104'. In FIG. 4 it is illustrated that two hinges 105' are disposed somewhat inboard from the edges 134' of side panel 104'. Hinges 105' are attached to both the side panel 104' and also a riser 132'. The hinges 105 on side panel 104 are illustrated in FIG. 4 as being disposed proximate the edges 134 of side panel 104. Hinges 105 are attached to both the side panel 104 and also a riser 132. It should be noted that in embodiments, the distance a hinge 105, 105' is from an edge 134, 134' of a side panel 104, 104' may be different within a particular side panel and/or between side panels. It should be noted that in embodiments, the distance a hinge 105, 105' is from an edge 134, 134' of a side panel 104, 104' may be the same within a particular side panel and/or between side panels.

It should be noted that the height of the fulcrum axes of the various hinges for the different side panels 104, 104', with respect to the floor 112, are different to accommodate the panels folded down in steps prior. For example, the first side panel 104 folded rests on both the front and rear panels 108, 106, when in a folded position. Therefore, the height of the riser 132 immediately below this side panel 104 is such that the fulcrum axis of the hinges 105 is approximately coplanar with the outward-facing surface 125 of the front panel 108 when the front panel 108 is in the folded position. Furthermore, the last side panel 104' folded rests on both the front and rear panels 108, 106 as well as the opposing side panel 104, when in a folded position. Therefore, the height of the riser 132' immediately below this side panel 104' is such that the fulcrum axis of the hinges 105' are approximately coplanar with the outward-facing surface 136 of side panel 104 when this side panel 104 is in the folded position.

The present description depicts specific examples to teach those skilled in the art how to make and use the best mode of the invention. For the purpose of teaching inventive principles, some conventional aspects have been simplified or omitted. Those skilled in the art will appreciate variations from these examples that fall within the scope of the invention.

The detailed descriptions of the above embodiments are not exhaustive descriptions of all embodiments contemplated by the inventors to be within the scope of the invention. Indeed, persons skilled in the art will recognize that certain elements of the above-described embodiments may variously be combined or eliminated to create further embodiments, and such further embodiments fall within the scope and teachings of the invention. It will also be apparent to those of ordinary skill in the art that the above-described embodiments may be combined in whole or in part to create additional embodiments within the scope and teachings of the invention.

Thus, although specific embodiments of, and examples for, the invention are described herein for illustrative purposes, various equivalent modifications are possible within the scope of the invention, as those skilled in the relevant art will recognize. The teachings provided herein may be applied to other embodiments than those described above and shown in the accompanying figures. Accordingly, the scope of the invention is determined from the following claims.

We claim:

1. A folding container, comprising:

a base comprising a floor;

at least two side panels mechanically attached to the base;

a rear panel comprising rear hinges attached thereto, pivotably connected to the base, and operable to pivot between a folded position that contacts the floor and a vertically deployed position;

hinge blocks attached to the base, each hinge block disposed proximate opposing edges of the base, and separated by a space proximate a top plane of the floor and between each hinge block;

a front panel comprising a first support member and a second support member and a top support member that couples the first and second support members, and further comprising a front door hingedly attached to at least one of the first and second support members, and further comprising at least two front hinges, each pivotably connected to one of the hinge blocks, and wherein the front panel is operable to pivot between a folded position that contacts the rear panel and a vertically deployed position; and a recess proximate an intersection of the top plane of the floor and a front plane of an edge rail, wherein the recess is disposed downwardly from the top plane of the floor;

an extension region defined by the front door that protrudes past the top plane of the floor when the front panel is in the vertically deployed position, wherein the extension region engages the recess when the front panel is in the vertically deployed position, and wherein the recess comprises a size and dimension to accept the extension region.

2. The folding container of claim 1, wherein the rear panel comprises a rear door.

3. The folding container of claim 1, wherein:

a fulcrum of the rear hinges is approximately coplanar with the floor; and a fulcrum of the front hinges is approximately coplanar with an outward-facing surface of the rear panel, when the rear panel is in the folded position.

4. The folding container of claim 1, wherein an interface of the extension region to the recess defines a door seal and a door travel limit.

5. The folding container of claim 1, wherein the first and second support members are attached to the front hinges, and the rear panel comprises support members attached to the rear hinges.

6. The folding container of claim 1, wherein the at least two side panels are foldable.

7. The folding container of claim 6, comprising:

a first horizontal riser disposed proximate the base;

a second horizontal riser disposed proximate the base;

hinges attached to a first side panel of the at least two side panels and the first horizontal riser, wherein the first side panel is pivotably connected to the first horizontal riser;

hinges attached to a second side panel of the at least two side panels and the second horizontal riser, wherein the second side panel is pivotably connected to the second horizontal riser;

wherein a fulcrum axis of the hinges attached to the first side panel is approximately coplanar with an outward-facing surface of the front panel, when the front panel is in the folded position; and wherein a fulcrum axis of the hinges attached to the second side panel is approximately coplanar with an outward-facing surface of the first side panel, when the first side panel is in the folded position.

* * * * *